US006666485B1

(12) United States Patent
Moret

(10) Patent No.: US 6,666,485 B1
(45) Date of Patent: Dec. 23, 2003

(54) DEVICE FOR LOCKING/UNLOCKING BY GRAVITY, THE LID OF A CONTAINER AND A CONTAINER EQUIPPED THEREWITH

(75) Inventor: Michel Moret, Eaubonne (FR)

(73) Assignee: Michael Moret, Eaubonne (FR)

( * ) Notice: Subject to any disclaimer, the term of this patent is extended or adjusted under 35 U.S.C. 154(b) by 44 days.

(21) Appl. No.: 09/830,958

(22) PCT Filed: Aug. 30, 2000

(86) PCT No.: PCT/FR00/02404

§ 371 (c)(1),
(2), (4) Date: May 3, 2001

(87) PCT Pub. No.: WO01/17880

PCT Pub. Date: Mar. 15, 2001

(30) Foreign Application Priority Data

Sep. 3, 1999 (FR) ..... 99 11081

(51) Int. Cl.[7] ..... E05C 19/10
(52) U.S. Cl. ..... 292/130; 220/315
(58) Field of Search ..... 292/230, 231, 292/237, 236, 233, 130, 131, 134, 341.15; 220/908, 315; 414/407, 414

(56) References Cited

U.S. PATENT DOCUMENTS

| | | | | | |
|---|---|---|---|---|---|
| 3,642,314 | A | * | 2/1972 | Smith et al. | 292/134 |
| 4,152,979 | A | * | 5/1979 | Schmidt | 100/100 |
| 4,155,584 | A | * | 5/1979 | Pracchia | 294/68.1 |
| 4,585,139 | A | * | 4/1986 | Bronson et al. | 206/305 |
| 5,042,856 | A | * | 8/1991 | Goodman | 220/315 |
| 5,085,341 | A | * | 2/1992 | Hodge | 220/811 |
| 5,094,358 | A | * | 3/1992 | Serio, Sr. | 220/315 |
| 5,094,487 | A | * | 3/1992 | Drewry | 220/908 |
| 5,118,000 | A | * | 6/1992 | Howell et al. | 220/315 |
| 5,201,434 | A | * | 4/1993 | DeVivo et al. | 220/315 |
| 5,224,744 | A | * | 7/1993 | Michelutti | 220/908 |
| 5,415,314 | A | * | 5/1995 | McCollum | 220/264 |
| 5,419,598 | A | * | 5/1995 | Kreitzer | 292/205 |
| 5,474,341 | A | * | 12/1995 | Putman et al. | 220/315 |
| 5,599,050 | A | * | 2/1997 | Tinsley | 220/908 |
| 6,145,898 | A | * | 11/2000 | Onderka et al. | 292/198 |
| 6,290,093 | B1 | * | 9/2001 | Obriot et al. | 220/324 |

FOREIGN PATENT DOCUMENTS

| | | |
|---|---|---|
| DE | 295 11098 | 11/1996 |
| EP | 0 698 567 | 2/1996 |
| EP | 0 704 387 | 4/1996 |
| EP | 0 872 432 | 10/1998 |

* cited by examiner

*Primary Examiner*—J. J. Swann
*Assistant Examiner*—Thomas Ho
(74) *Attorney, Agent, or Firm*—Blank Rome, LLP

(57) ABSTRACT

A locking/unlocking device for a waste collection container for automatically locking/unlocking, by gravity, the lid (2) of the container (1) on the vessel (4) of the container. A pivoting piece (8) is fixed in an articulated fashion to the internal face of the lid, and has a lever (8*d*) having a hook (9) engaging in an orifice (13) in the vessel; and an arm 8*b*) coming into engagement with a hook (7*c*) on an articulated angled piece (7). Tilting of the container (1) causes, by gravity effect, the pivoting of the angled piece (7) and then the pivoting of the pivoting piece (8) thus released from the hook (7*c*), towards an unlocked position. The device also relates to a container equipped with such a locking/unlocking device.

17 Claims, 7 Drawing Sheets

DEVICE FOR LOCKING/UNLOCKING BY GRAVITY, THE LID OF A CONTAINER AND A CONTAINER EQUIPPED THEREWITH

BACKGROUND OF THE INVENTION

1. Field of the Invention

The invention relates to a device for automatic locking/unlocking by gravity for locking the lid of a container on the top edge of the vessel of the container. This container is intended to be emptied by tilting. It can notably be used for the collection of waste.

2. Description of Related Art

Containers intended for waste collection need to stay on the public highway whilst awaiting the passage of the vehicles intended to collect the waste.

These containers, left without supervision, may be searched through, which may prove dangerous depending on the nature of the waste contained in the containers.

In the context of the selective collection of waste, the lids on the containers are provided with an opening with a size and shape adapted to the waste which is to be disposed in these containers.

The absence of a locking device for these containers may allow their unwanted filling with inappropriate waste making such a so-called "selective" collection ineffective.

A system for locking the container whilst it is being filled and for unlocking it when it is emptied therefore proves necessary.

A certain number of patents refer to locking/unlocking systems for waste container lids.

By way of example, the documents EP-A-698 567 and EP-A-704 387 refer to a locking system which engages, after the closure of the lid, in a support element, so that the lid is protected against opening.

In the case of the document EP-A-698 567, the opening of the lid takes place by the electromagnetic actuation of a device which acts on the support element in which the locking system engages.

In the case of the document EP-A-704 387, the opening of the lid takes place by means of an operating button.

In these two cases, the opening of the lid requires a manoeuvre, notably manual, on the part of the operator and may take place whatever the position of the container in space.

The documents FR-A-2 762 306 and EP-A-872 432 describe a device for locking the lid of a container on the vessel of the said container not requiring the manual intervention of the operator to allow the locking or unlocking of the lid.

The locking device described in these documents has a pivoting piece pivotally mounted under the container lid and coming into engagement with a male attachment device situated on the internal wall of the container.

When a container provided with such a locking device is in the filling position, the pivoting piece adopts a locked position in which it is in engagement with a male attachment device causing the lid to be maintained in the closed position.

When the same container is tilted by a skip lorry, for example, in order to be emptied into the skip thereof, the pivoting piece passes from its locked position to an unlocked position in which it is released from the attachment device under the effect of gravity.

The tilting of the container thus allows the opening of the lid on the container and therefore the emptying of the latter by discharging the waste under the effect of gravity.

Given the size and weight of such waste containers, the tilting operation is practically exclusively reserved for skip lorries intended for this purpose and in practice cannot be carried out by a third party. This has the effect of preventing the opening of the containers by a third party and thus preventing the filling of the containers with waste other than that for which they are intended.

All the types of locking/unlocking devices dealt with above have the major drawback of making it impossible to nest the containers since the lid locking mechanism occupies a not insignificant amount of space on the internal wall of the vessel.

This impossibility of nesting the containers when they are transported gives rise to an appreciable increase in transportation costs.

Moreover, the presence of a locking/unlocking device or of a housing on the internal wall of the container vessel, as described in the above mentioned documents, interferes with the flow of the waste when the container is emptied. This has the consequence of encouraging the accumulation of waste at the locking/unlocking device or housing and therefore complicates the maintenance and cleaning of the vessels.

SUMMARY OF THE INVENTION

The invention aims to afford solutions to these technical problems. It consists of a device for the locking/unlocking of a container without the manual intervention of the operator, the walls of the vessel being smooth and uniform, which allows the nesting of the containers and a good flow of the waste.

To this end, the invention proposes a locking/unlocking device for a waste collection container, the said container having a vessel and a lid associated with the vessel and being able to be moved between a closed position and an open position, the device enabling the container lid to be locked on the end part of the vessel when the container is in the filling position, and to be unlocked when the vessel is in the emptying position.

The device comprises a pivoting piece, itself comprising:

- a lever fixed so as to be articulated on the internal face of the lid and projecting inside the container when the lid is in the closed position;
- an arm extending the articulation of the lever extending underneath the internal face of the lid when the latter is in the closed position;
- an intermediate part to which the lever and arm are fixed through which the axis of rotation of the said pivoting piece passes.

According to the invention, the lever has a retractable hook intended to be engaged in an orifice or hollow situated at the end part of the vessel, the arm having an end part, opposite to the intermediate part of the pivoting piece, coming into engagement with a hook forming part of an angled piece. The said angled piece comprises on the one hand a locking leg including the hook and on the other hand a driving leg and is articulated on an axis of rotation parallel to the axis of rotation of the pivoting piece, the driving leg of the angled piece being locked in the lid locking position by a stop. In addition, means are provided so that the tilting of the container at a certain angle causes, by gravity effect, the pivoting of the angled piece and, by gravity effect, the pivoting of the arm and of the lever towards an unlocked position.

According to the invention, when the container is in the filling position, the centre of gravity of the angled piece is situated so that it holds the driving leg of the angled piece in abutment on the stop and the hook on the angled piece in engagement with the end part of the arm on the pivoting piece, the centre of gravity of the assembly comprising the pivoting piece and the hook being situated so as to hold the retractable hook on the lever in the position of engagement in the orifice in the end part of the vessel and the end part of the arm in engagement with the hook on the angled piece. The tilting of the container through a certain angle with respect to the vertical when it is emptied gives rise to a movement of the said centres of gravity, causing a pivoting of the angled piece, releasing the hook on the angled piece from the end part of the arm on the pivoting piece, giving rise to the pivoting of the arm and of the lever, and, finally, leading to the disengagement of the retractable hook from the orifice in the vessel and therefore to the opening of the container lid.

According to other characteristics, the retractable hook on the lever is articulated on an axis substantially parallel to the axis of rotation of the pivoting piece, which allows, when the lid is closed on the end part of the vessel, a sliding of the retractable hook along the internal wall of the container until the retractable hook is inserted in the orifice or hollow situated at the end part of the vessel.

The pivoting of the arm about the axis of rotation of the pivoting piece, and the pivoting of the angled piece about its axis of rotation, in the opposite direction to the internal face of the container lid, are each limited by a stop.

The end part of the arm opposite to the intermediate part of the pivoting piece, and/or the free end part of the driving leg, has or have a weight.

According to a first embodiment, the angled piece has the shape of a V, the two legs of which form an angle of around 35 to 55 degrees, notably around 45 degrees.

According to a second embodiment, the angled piece has the shape of a V whose two legs form an angle of between 90 and 180 degrees.

According to a third embodiment, the locking/unlocking device comprises a rocker arm able to move in rotation about a shaft connected to the container lid and substantially parallel to the axis of rotation of the angled piece, the rocker arm being able to move between a locked position in which the rocker arm forms a stop opposing the pivoting of the angled piece towards the internal face of the lid, and an unlocked position in which the rocker arm does not oppose the said pivoting of the angled piece, the rotation of the rocker arm between the said locked and unlocked positions being obtained when the container is tilted at a certain angle, by gravity effect.

In a variant of the third embodiment, the rocker arm has the shape of a circular sector, the axis of rotation of the rocker arm being situated close to the apex of the said circular sector, and the free end edge of the rocker arm being, when the rocker arm is in the locked position, in contact with the driving leg of the angled piece.

The two legs of the angled piece may be able to move in rotation with respect to each other, about the axis of rotation of the angled piece, the driving leg of the angled piece comprising, towards its end part, a weight, so that, when the container is tilted at a certain angle, the locking leg on the angled piece being still in engagement with the arm, the driving leg of the angled piece can pivot about its axis, by gravity effect, and then strike the hook so as to release it from the arm.

In a variant, the driving leg of the angled piece comprises, towards its end part, a projection intended, when the container is titled at a cession angle, to strike the hook so as to release it from the arm.

The locking/unlocking device according to the invention can also include a release system fixed to the container lid and intended to be actuated by a control member, in order to unlock the lid from the container when the container is in the filling position.

The locking/unlocking device is protected by a housing fixed on the internal face of the lid and having an opening from which the retractable hook on the lever projects, the housing being able to form a stop for the angled piece, thus limiting its movement in the opposite direction to the internal face of the lid.

The locking/unlocking device also preferably has a device for protecting the retractable hook fixed to the container vessel.

According to a second aspect, the object of the invention is a container for collecting waste, having a locking/unlocking device as described above.

BRIEF DESCRIPTION OF THE DRAWING

Other particularities and advantages of the invention will also emerge from the following description, with reference to the accompanying figures, in which.

DETAILED DESCRIPTION OF THE INVENTION

A waste collection container 1 typically has a vessel 4 and a lid 2 articulated on the vessel 4, for example by means of hinges.

The container 1 can be in a filling position, in which it rests substantially vertically on the ground and where it can be filled by a user, or in an emptying position, in which the container 1 has been tilted through a certain angle—greater than 90°—with respect to the vertical, the vessel 1 then being able to be emptied of its contents.

The container 1 comprises a substantially flat bottom, situated facing the ground when the container 1 is in the filling position, and four walls extending substantially perpendicularly to the bottom, and substantially at right angles to each other in pairs, so as to form a parallelepiped, the free end edges of the said walls delimiting an opening through which the waste can be introduced into the vessel 4.

The vessel 4 can also have wheels mounted on the bottom and resting on the ground, when the container 1 is in the filling position, the wheels being intended to facilitate the movement of the container 1 by a user.

The lid 2 has a substantially flat wall, intended to cover the opening in the vessel 4, and rims projecting from the flat wall. In the context of the selective collection of waste, the lid 2 on the container 1 may have an opening (not shown) whose size and shape are adapted to the objects, for example newspapers or bottles, which are to be collected in the container.

The lid 2 is pivotally associated with the vessel 4. To this end, hinges are provided close to the free end part of one of the walls of the vessel 4, this wall being said to be "rear". The wall of the vessel parallel to the rear wall is said to be "front" 4*c* throughout the description.

The lid 2 can thus be moved—notably manually—between a closed position of the container 1, in which it rests on the free end edges of the walls of the vessel 4, thus obstructing the opening in the vessel 4, and an open position, in which the substantially flat wall of the lid 2 is separated from the free end edges of the walls of the vessel 4, the extreme open position of the lid 2 corresponding to the case where the substantially flat wall of the lid 2 is substantially parallel to the rear wall of the vessel 4.

It will therefore be understood that the tilting of the container 1 towards its emptying position must be effected substantially in a plane at right angles to the rear and front walls, so as to permit the opening of the lid 2 and, in this way, the release of the opening in the vessel 4 allowing the vessel 4 to be emptied.

The lid 2 has on the one hand an internal face 2*a* directed, when the lid 2 is in the closed position, towards the inside of the vessel 4, and on the other hand an external face 2*b* directed towards the outside of the said vessel.

The vessel 4 can be made from plastics material moulded in one piece, just like the lid 2.

Figure 1:
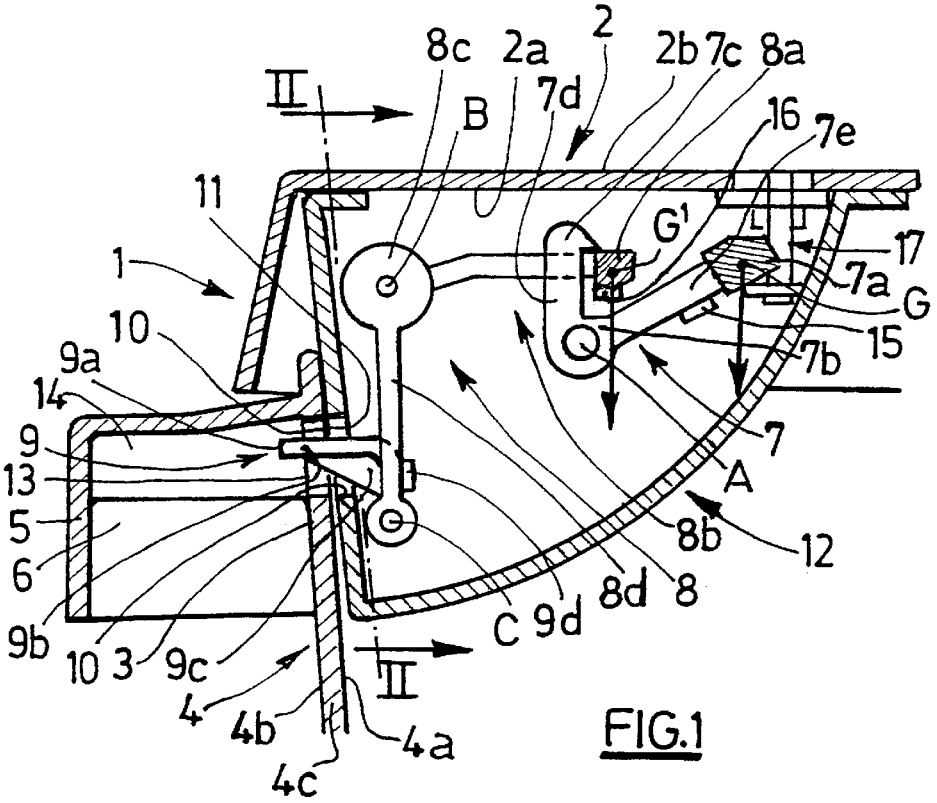
FIG. 1 is a partial view in longitudinal section of a container in the filling position, showing a locking/unlocking device in the locked position, according to a first embodiment of the invention.

The vessel 4 also has, close to the free end parts of its walls, a flange 5 extending outside the vessel 4 and defining a recess 6 whose opening is directed towards the bottom (see FIG. 1). The recess 6 is intended to receive suitable gripping means allowing the lifting and tilting of the container 1, by a collection vehicle for example. A honeycomb 14 may be situated inside the recess 6, so as to reinforce the flange 5.

A description is now given of the locking/unlocking device according to the invention.

The locking/unlocking device enables the lid 2 to be locked in the closed position on the container 1, when the container 1 is in the filling position, as illustrated notably in FIG. 1. It also allows the automatic unlocking of the lid 2 (see notably FIGS. 3 and 4) when the container 1 is tilted from the filling position, the lid 2 being in the closed position, to the emptying position.

Reference is made first of all to FIGS. 1 to 4, which illustrate a first embodiment of the invention.

A locking/unlocking device is mounted on the internal face 2*a* of the lid 2 on the container 1.

This device includes several pieces cooperating with each other to allow the locking or unlocking of the lid 2 on the container 1, and notably an angled piece 7, a pivoting piece 8 and a retractable hook 9.

These pieces may be metallic or made from any other material able to confer on them, notably, rigidity and resistance to impacts and wear.

These pieces are each articulated about an axis, respectively: the axis of rotation A of the angled piece 7, the axis of rotation B of the pivoting piece 8 and the axis of rotation C of the retractable hook 9. These axes are substantially parallel to each other.

The angled piece 7 has the shape of a V comprising:

- a first leg 7*d*, referred to as the "locking leg", having, at its free end part, a hook 7*c*,
- a second leg 7*e*, referred to as the "driving leg", having, at its free end part, a weight 7*a*,
- an intermediate part 7*b* connecting the two legs 7*d*, 7*e* of the angled piece 7 and through which the axis of rotation A of the said angled piece 7 passes. The intermediate piece 7*c* can have a rounded shape.

The axis of rotation A of the angled piece is connected to the lid 2 and directed, when the lid 2 is in the closed position, substantially parallel to the bottom and to the front wall 4*c* of the vessel 4. In addition, the axis of rotation A is substantially perpendicular to the mid-plane of the angled piece 7.

When the container 1 is in the filling position, the lid 2 being closed, the locking leg 7*d* is substantially vertical, the hook 7*c* being situated above the axis of rotation A.

In this first embodiment, the two legs 7*d*, 7*e* of the angled piece 7 are rigidly connected to each other, the angle between them being around 35° to 55°, notably around 45°.

The pivoting piece 8 has:

- a lever 8*d* lying, when the container 1 is in the filling position and the lid 2 closed, substantially vertically;
- an arm 8*b*, extending the lever 8*d* and lying, when the container 1 is in the filling position and the lid 2 closed, substantially perpendicular to the front wall 4*c* of the vessel 4;
- an intermediate piece 8*c* to which the lever 8*d* and the arm 8*b* are rigidly fixed by one of their ends. The axis of rotation B of the pivoting piece 8 passes through this intermediate piece 8*c*. The intermediate piece 8*c* can have a rounded shape.

The axis of rotation B of the angled piece is connected to the lid 2 and is substantially parallel to the axis A of the angled piece 7 and substantially perpendical to the mid-plane of the pivoting piece 8.

The end part 8*e* of the arm 8*b*, opposite to the intermediate part 8*c*, has a weight 8*a*.

In addition, the pivoting piece 8 has a retractable hook 9, mounted for pivoting about an axis C, close to the end part of the lever 8*d* opposite to the intermediate part 8*c*, the axis C being substantially parallel to the axis A of the angled piece 7.

The retractable hook 9 comprises a substantially flat wall 9*b*, with a free end 9*a* situated opposite to the articulation point of the said retractable hook 9 with the lever 8*d*, the said wall 9*b* being disposed substantially parallel to the bottom of the vessel 4 when the locking/unlocking device is in the locking position.

The retractable hook 9 also comprises a rib 9*c* connecting the end 9*a* of the retractable hook 9 to the point of connection of the said hook 9 with the lever 8*d*. The function of the rib 9*c* is on the one hand to stiffen the retractable hook 9 and on the other hand to afford better guidance of the hook 9.

Finally, the retractable hook 9 comprises a protuberance 9*d* situated close to the axis of rotation C of the retractable hook 9 and intended to come into abutment against the lever 8*d* in order to limit the pivoting of the retractable hook 9 about its axis of rotation C.

The retractable hook 9 is intended to cause the lid 2 to be fixed to the vessel 4 at the level of the front wall 4*c* of the vessel 4 when the lid 2 is in the closed position, the container 1 being in the filling position.

The locking/unlocking device is described in the locked position, the container 1 being in the filling position, the lid 2 being closed. The pieces 7, 8 are in the positions previously described.

The locking/unlocking device is fixed to the lid 2 so that, when the lid 2 is closed, the end 9*a* of the hook 9 is directed towards the front wall 4*c* of the vessel 4, and engages in an orifice 13 or a hollow in the front wall 4*c* situated close to the end part 3 of the said front wall 4*c* opposite to the bottom of the vessel 4, the said orifice 13 opening out into the recess 6. The orifice 13 is delimited by edges 10.

The hollow can be a cavity hollowed out in the front wall 4*c* of the vessel 4 at the level of the internal face 4*a* of the said front wall 4*c*.

In this configuration, the pivoting of the retractable hook 9 in the anti-clockwise direction (with reference to FIG. 1) is limited by the protuberance 9*b*.

Because of the presence of the weights 7*a*, 8*a*, the angled piece 7 and the pivoting piece 8 have a tendency to pivot in the clockwise direction (with reference to FIG. 1). This movement is prevented respectively by a stop 15 and a stop 16, the said stops being fixed to the lid 2.

Figure 2:
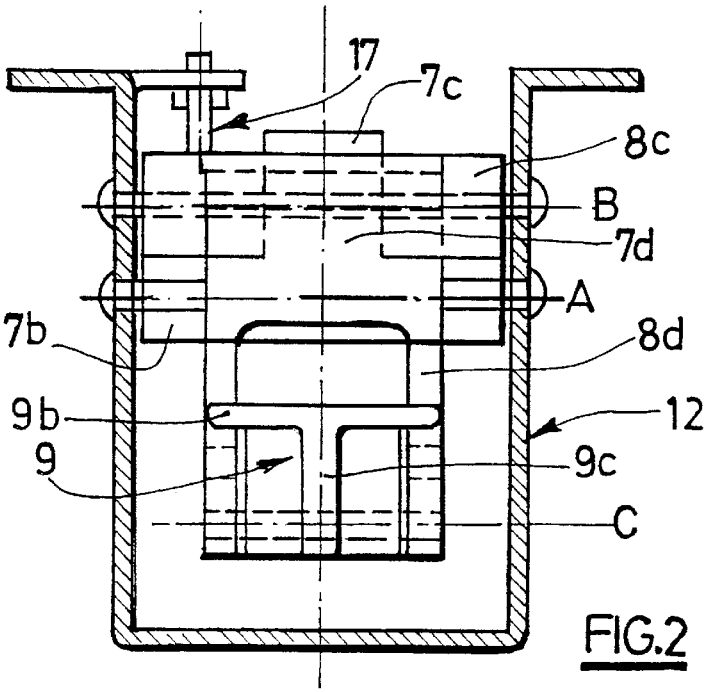
FIG. 2 is a view in section along the line II—II in FIG. 1.

Preferably, the locking/unlocking device is fixed to a housing 12 itself fixed to the internal face 2*a* of the lid 2, so that the said device is protected from the content of the vessel 4. As indicated in FIG. 2, the axes of rotation A, B are fixed to the housing 12, as well as the stops 15, 16.

The housing 12 has an opening 11, intended to cooperate with the orifice 13 or the hollow in the front wall 4*c* of the vessel 4, so as to allow the passage of the retractable hook 9. The opening 11 in the housing 12 must be sufficient to allow the movement of the retractable hook 9 when the lid 2 is closed and opened.

An explanation will now be given, with reference to FIGS. 3 and 4, of the functioning of the locking/unlocking device according to the invention.

When the container 1 passes from its filling position (FIG. 1) to its emptying position (FIGS. 3 and 4), the lid 2 passes from a closed position to an open position, thus allowing the emptying of the content of the vessel 4.

Figure 3:
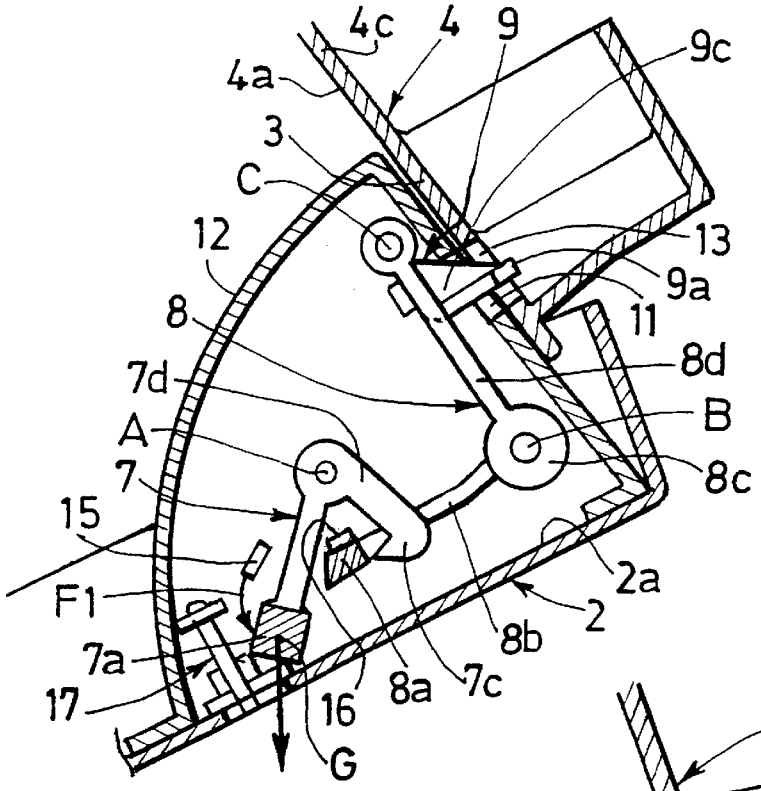
FIGS. 3 and 4 are partial views in longitudinal section of the container of FIG. 1, in the emptying position, illustrating the functioning of the device when it is unlocked.
Figure 4:
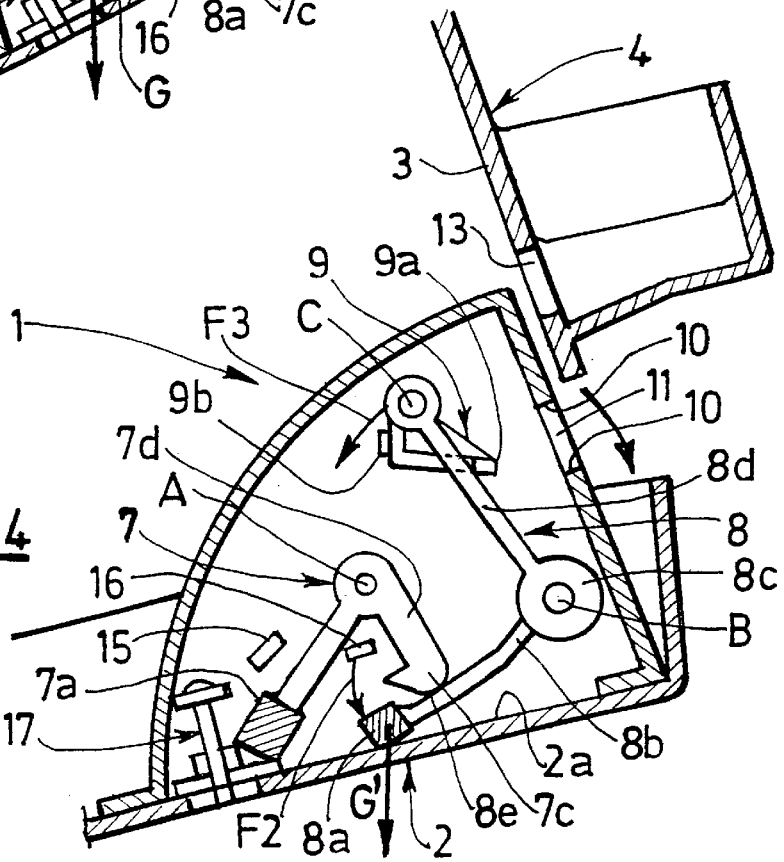

The container 1 is tilted with respect to the vertical, and in a plane substantially perpendicular to the rear and front walls 4*c*, by a certain angle (FIGS. 3 and 4).

Because of the presence of the weight 7*a* on the angled piece 7, by gravity effect G, the angled piece 7, initially in abutment on the stop 15, moves in the direction of the internal face 2*a* of the lid 2, in the direction of the arrow F1.

The hook 7*c* on the angled piece 7 then releases the end part 8*e* of the arm 8*b*.

Consequently the arm 8*b*, initially in abutment on the stop 16, because of the presence of the weight 8*a*, is free to move by gravity effect G' in the direction of the internal face 2*a* of the lid 2, in the direction of the arrow F2, driving in its rotation movement the lever 8*d* and the retractable hook 9.

The rotation of the lever 8*d* in the direction of the arrow F3—and therefore of the retractable hook 9—about the axis of rotation B of the pivoting piece 8 causes the retractable hook 9 to leave the orifice 13 or the hollow in the vessel 4, the hook then being able to pivot about the axis C.

The rotation of the retractable hook 9 about the axis C is limited, in this direction, by the substantially flat wall 9*b*, coming into abutment on the lever 8*d*.

The lid 2 no longer being fixed to the container 1, because of the tilting of the vessel 1 and the effect of gravity, the lid 2 opens by pivoting about the axis of rotation of its hinges, thus enabling the vessel 4 to be emptied.

When the container 1 is replaced in its filling position, and when the lid 2 passes from its open position to its closed position, the gravity exerted on the weight 8*a* of the pivoting piece 8 leads to the pivoting of the arm 8*b* from the internal face 2*a* of the lid 2, against which it was situated, towards the stop 16, which stops the movement of the said arm 8*b*.

In the same time, the retractable hook 9 moves along the internal face 4*a* of the vessel 4 in the direction of the bottom of the vessel 4, until it is housed in the orifice 13 or the hollow in the front wall 4*c* of the vessel 4. These movements of the retractable hook 9 are made possible by the articulation of the said hook 9 about its axis of rotation C.

The effect of gravity on the weight 7*a* then results in the pivoting of the angled piece 7 from the internal face 2*a* of the lid 2 to the stop 15, which stops the rotation movement of the said angled piece 7.

The hook 7*c* situated at the free end part of the locking leg 7*d* of the angled piece 7 then comes into engagement with the end part 8*e* of the arm 8*b* of the pivoting piece 8, preventing the movement of the latter.

The device is thus in the locking position and the container 1 in the filling position with its lid 2 in the closed position.

The locking/unlocking device can also have a release system 17 fixed to the substantially flat wall of the lid 2 of the container 1 and intended to be actuated by a control device, such as a key (not shown), the said release system 17 making it possible to unlock the lid 2 from the container 1 when the container 1 is in the filling position, without a tilting of the said container 1 being necessary.

Figure 5:
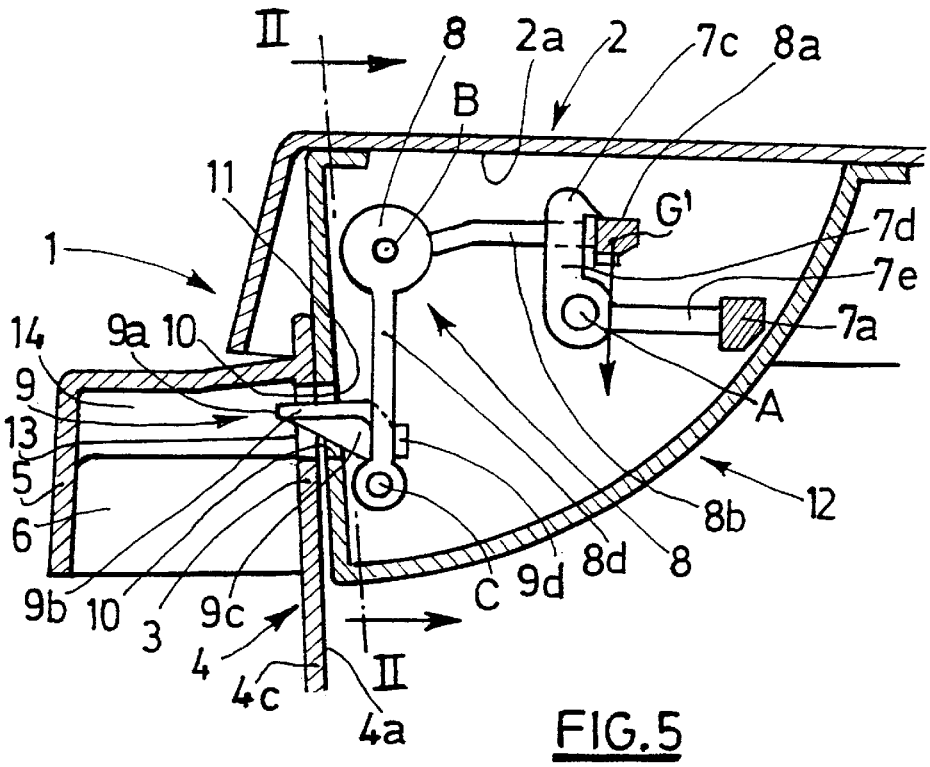
FIG. 5 is a partial view in longitudinal section of a container in the filling position, showing a locking/unlocking device in the locked position, according to a second embodiment of the invention.

Reference is now made to FIG. 5, which illustrates a second embodiment of the invention.

The difference from the first embodiment, as has just been described, is the angle between the two legs 7*d*, 7*e* of the angled piece 7. This is because, in the second embodiment, this angle is between 90° and 180°, notably close to 90°. The driving leg 7*e* of the angled piece 7 is thus substantially horizontal, when the container 1 is in the filling position, the lid 2 being closed. The stop 15 of the first embodiment is then no longer necessary, the housing 12 forming a stop for the driving leg 7*e* of the angled piece 7.

The advantage of this second embodiment is the stability of the device in the locking position. This is because, unlike the first embodiment, the weight 7*a* is situated, when the container 1 is in the filling position and the lid 2 closed, at the same level as the axis of rotation A of the angled piece 7, or below.

Thus an impact exerted against the front wall 4*c* of the container 4 does not have a tendency to unlock the device, unlike the device according to the first embodiment, where the weight 7*a* has a tendency to move, following such an impact, towards the internal face 2*a* of the lid 2, thus unlocking the device.

Reference is now made to FIGS. 6 to 10, which illustrate a third embodiment of the invention.

The locking/unlocking device comprises, as described above:

an angled piece 7 having a locking leg 7*d*, the free end of which is in the form of a hook 7*c*, a driving leg 7*e* whose free end part carries a weight 7*a*, and an intermediate part 7*b* forming the axis of rotation A of the said angled piece 7;

a pivoting piece 8 having a lever 8*d*, an arm 8*b*, the free end of which carries a weight 8*a*, an intermediate part 8*c* forming the axis of rotation B of the said pivoting piece 8 and a retractable hook 9 pivoting about an axis C.

In this third embodiment, the two legs 7*d*, 7*e* of the angled piece 7 are not rigidly connected but can pivot with respect to each other about the axis A.

The locking/unlocking device also comprises a rocker arm 18, in the form of a circular sector, able to move in rotation about an axis D linked to the lid 2 and substantially parallel to the axes of rotation A, B, C.

The axis of rotation of the rocker arm 18 is situated towards the apex 18*a* of the rocker arm 18, opposite to the free end edge 18*b* of the said rocker arm 18.

Figure 7:
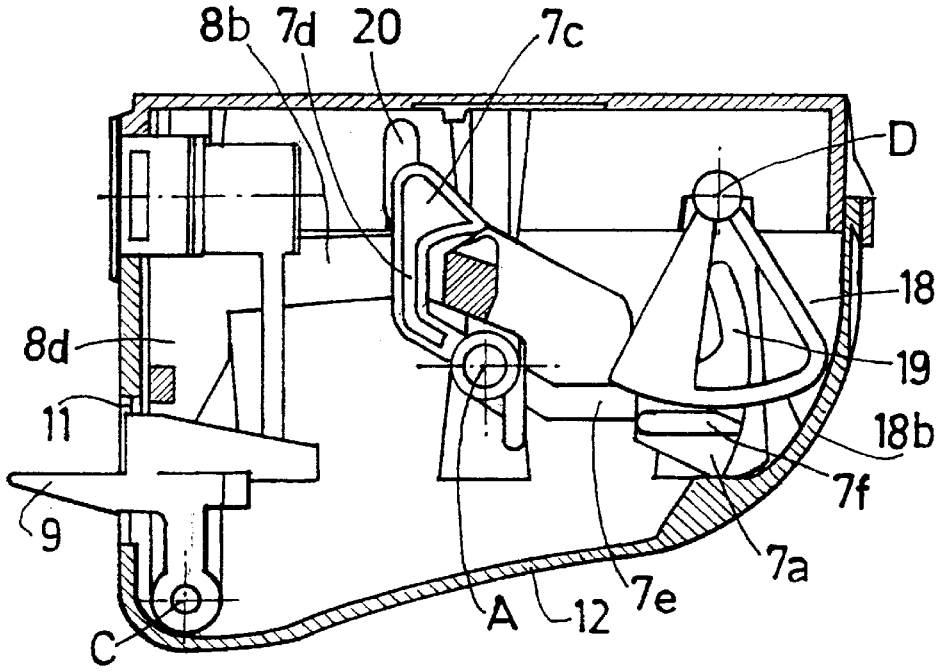
FIG. 7 is a view in longitudinal section of the device of FIG. 6, in the locked position.
Figure 8:
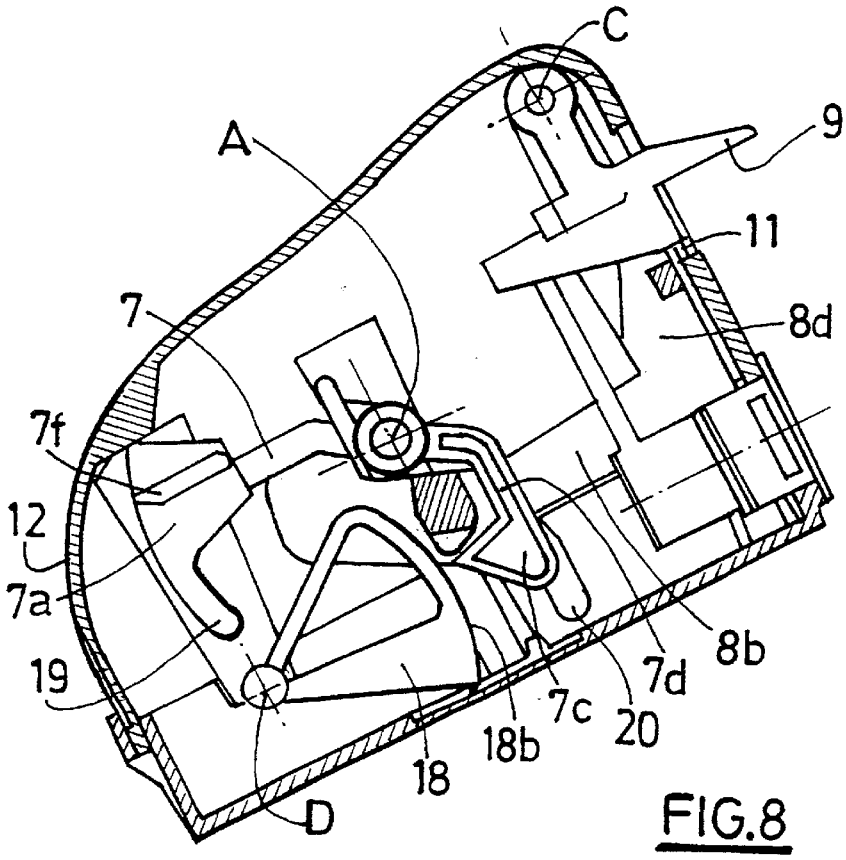
FIGS. 8 to 10 are views in longitudinal section of the device of FIG. 6 illustrating the functioning of the device when it is unlocked.
Figure 9:
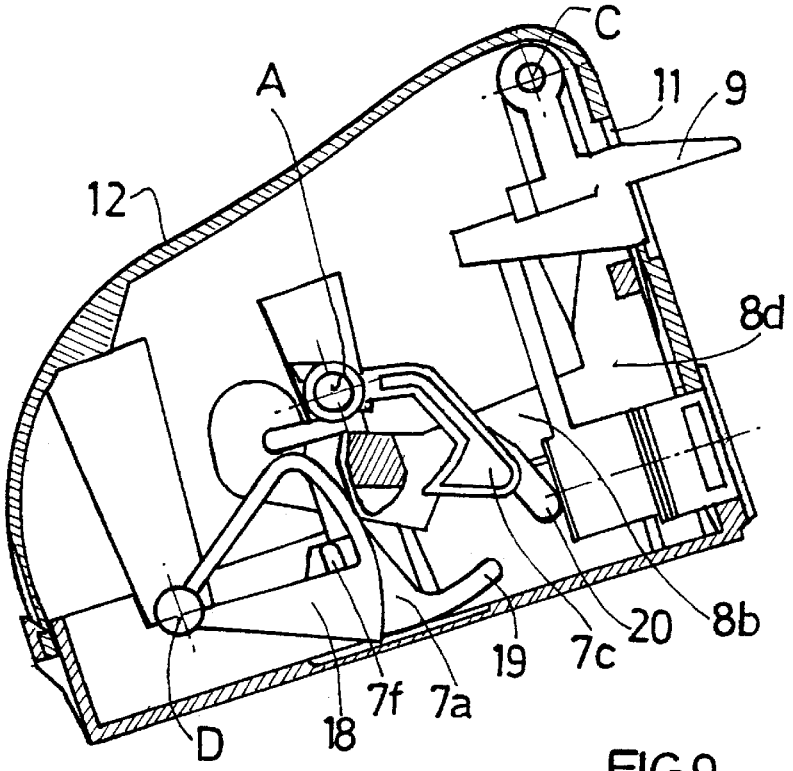

When the container 1 is in the filling position, the lid 2 being closed, the device is locked, as illustrated in FIG. 7.

The free end edge 18*b* of the rocker arm 18 is then directed towards the bottom of the vessel 4, and is in abutment on a lateral wall 7*f* of the angled piece 7, situated close to the weight 7*a*, at the free end part of the driving leg 7*e*. Thus the pivoting of the angled piece 7 about its axis A is limited in both directions, on the one hand by the housing 12 and on the other hand by the rocker arm 18.

The presence of the rocker arm 18 prevents the unwanted unlocking of the device following a vertical impact exerted on the container 1, the rocker arm 18 fulfilling the role of a movable stop.

Figure 10:
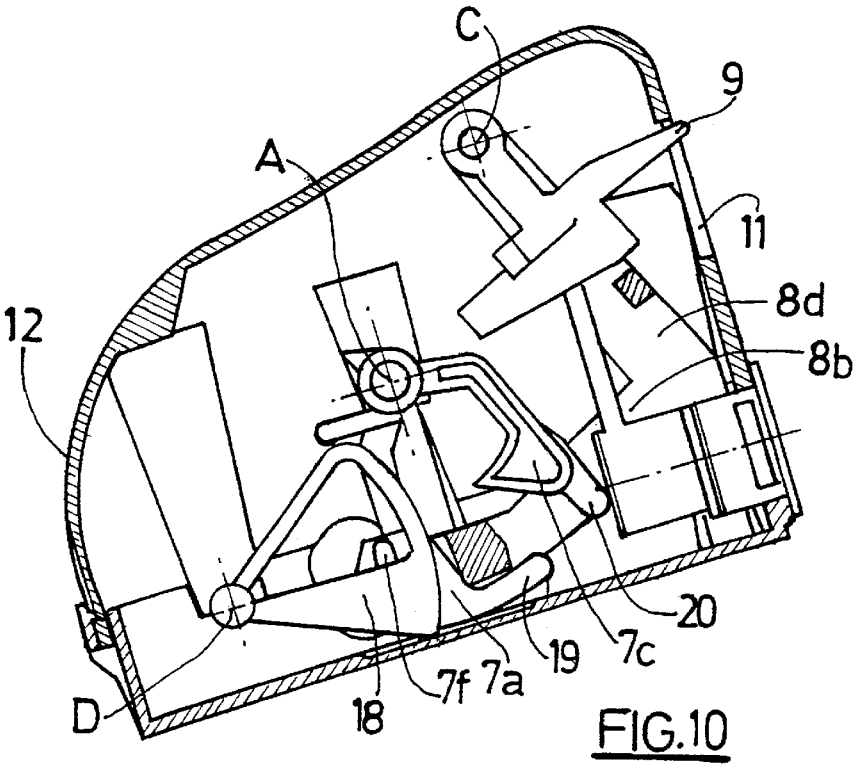

When the container 1 is tilted (FIGS. 8 to 10), the device unlocks in the following way:

by gravity effect, the rocker arm 18 pivots about its axis of rotation D (FIG. 8), this being assisted by the fact that the rocker arm has a solid part and a hollow part;

because of the weight 7*a*, and since the rocker arm 18 no longer forms a stop on the wall 7*f*, the driving leg 7*e* of the angled piece 7 pivots about the axis A towards the internal face 2*a* of the lid 2, the locking leg 7*d* remaining attached, by the hook 7*c*, to the pivoting piece 8;

the end part of the driving leg 7*e* strikes the end part of the locking leg 7*d*, thus releasing the hook 7*c* from the pivoting piece 8. The impact effect, intended to be added to the gravity effect for easier unlocking of the device, is accentuated by the presence of a projection 19 at the end of the driving leg 7*e*, intended to strike a projection 20 present on the hook 7*c;* the pivoting piece 8 thus released pivots, as well as the retractable hook 9, thus unlocking the lid (FIG. 10).

Figure 11:
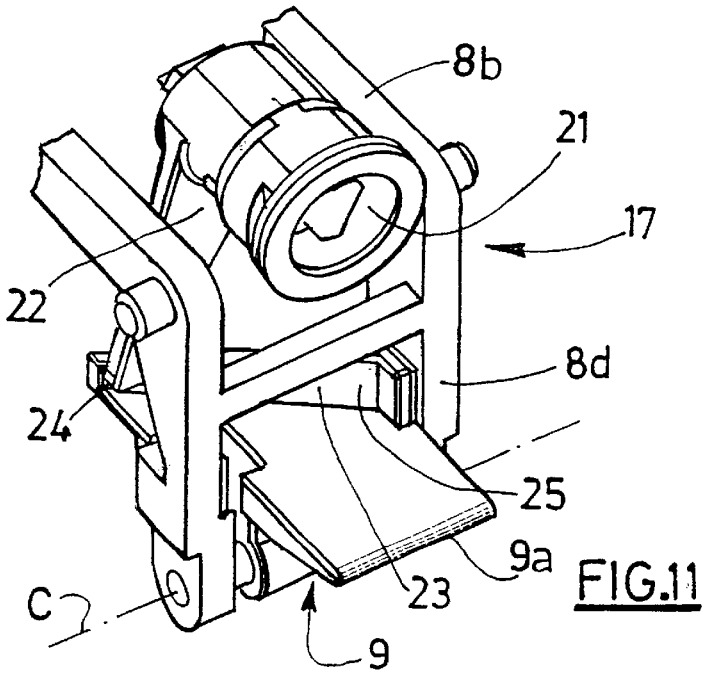
FIG. 11 is a partial perspective view of the release system of the locking/unlocking device of FIG. 6, the release system being in the inactive position.
Figure 6:
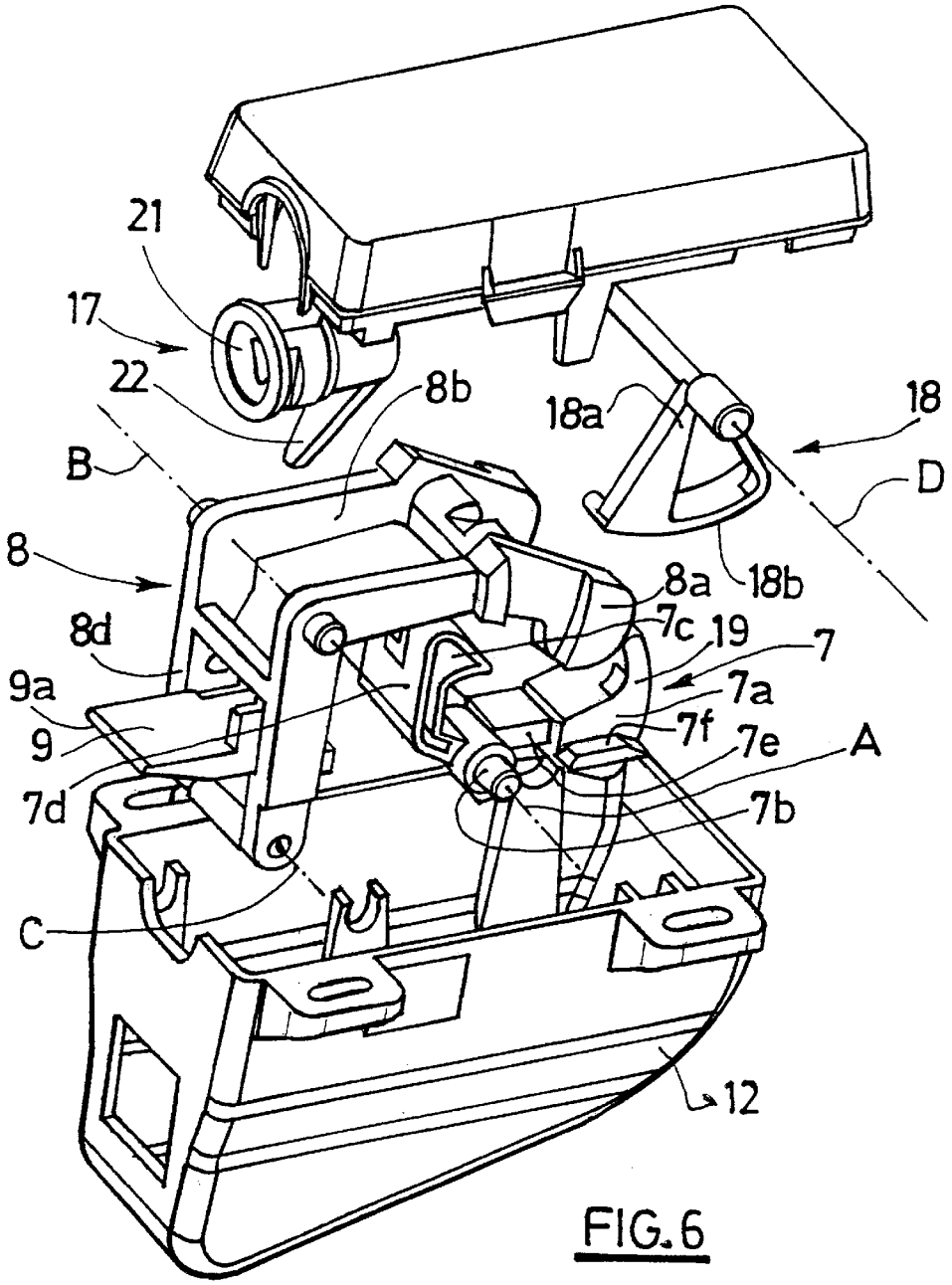
FIG. 6 is a view in exploded perspective of a locking/unlocking device according to a third embodiment of the invention.

The release system 17 for the locking/unlocking device is now described with reference notably to FIGS. 6 and 11.

As with the first and second embodiments, the release system 17 is intended to be actuated by a control device, such as a key (not shown), and makes it possible to unlock the lid 2 of the container 1 when the container 1 is in the filling position, without tilting of the said container 1 being necessary.

The unlocking system 17 has an opening 21, intended to cooperate with the control device, and fixed to the housing 12 so that, when the lid 2 is closed, the said opening 21 is accessible to a user through the front face of the lid. Not placing the opening 21 on the top of the lid 2 prevents damage due to frost.

The release system 17 also has a finger 22 able to be moved, by means of the control device, between an inactive position in which it does not act on the locking/unlocking device, and an active position in which the said device is unlocked.

To this end, the retractable hook 9 comprises a ramp 23 extending substantially perpendicularly to its flat wall 9*b*, and disposed obliquely with respect to the free end 9*a* of the said retractable hook 9.

In the inactive position, the finger 22 is in contact with the end part 24 of the ramp 23 situated furthest away from the free end 9*a* of the retractable hook 9, and exerts no force on the ramp 23. The retractable hook 9 is then engaged in the orifice 13 or the hollow in the vessel 4.

When a user, having engaged the control device in the opening 21, exerts a rotation force on the release system 17, he rotates the finger 22, the finger 22 thereby exerting a force on the ramp 23, which causes the finger 22 to slide along the ramp 23—towards the end part 25 of the ramp 23 situated closest to the free end 9*a* of the retractable hook 9—and the retractable hook 9 to pivot about its axis of rotation C.

In the active position, the finger 22 is therefore in contact with the end part 25 of the ramp 23 and exerts a force on it, the retractable hook 9 being disengaged from the orifice 13 or from the hollow in the vessel 4.

Conversely, the elimination of the force exerted by the user on the release system 17 causes return to the inactive position, in which the device is locked.

Moreover, the orifice 13 may be accessible from the outside of the container 1, through the recess 6, and an unauthorised person can then push the retractable hook 9 out of the orifice 13, so as to unlock the lid 2.

Figure 12:
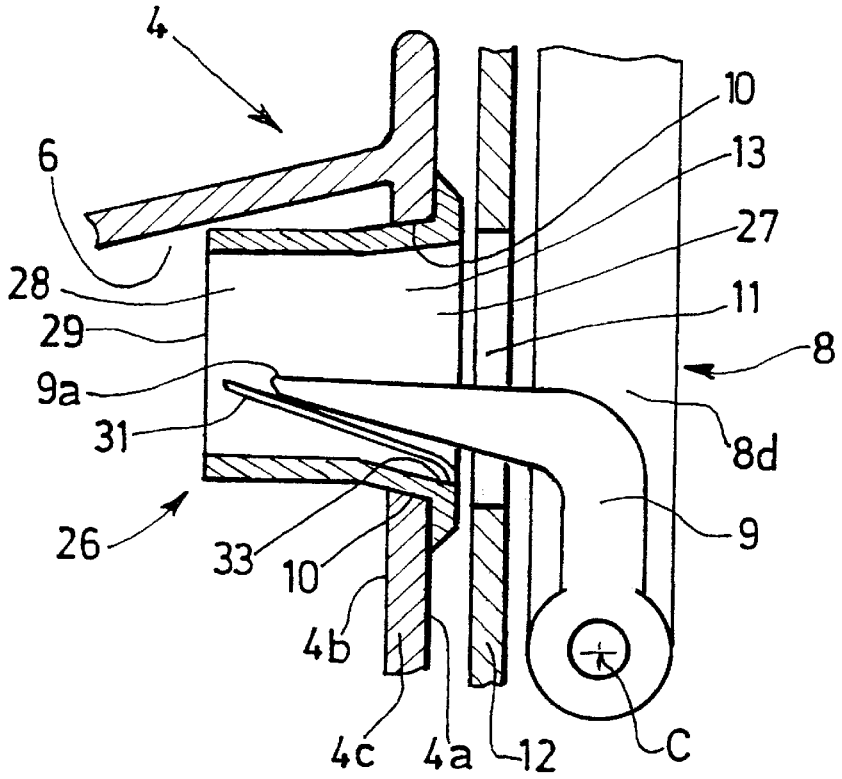
FIG. 12 is a view in partial section of a vessel in the filling position, showing the retractable hook engaged in a protective device.
Figure 13:
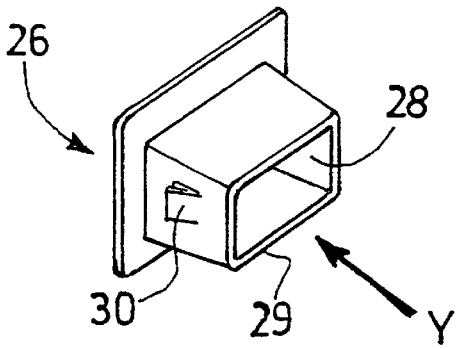
FIG. 13 is a view in perspective of the protective device of FIG. 12.
Figure 14:
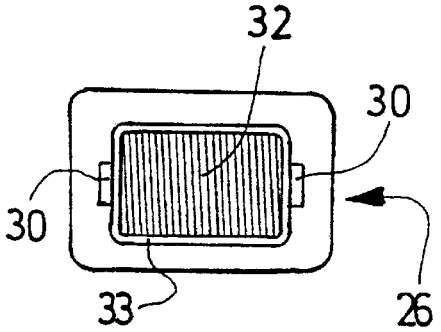
FIG. 14 is a view of the protective device in the direction of the arrow Y in FIG. 13, the retractable hook not being engaged in the protective device.

In order to remedy this problem, the locking/unlocking device can include a protective device 26, which is now described with reference to FIGS. 12 to 14.

The function of the protective device 26 is also to limit wear on the retractable hook 9, by reducing the rubbing of the said hook 9 against the edges 10 of the orifice 13 in the vessel 4, and to prevent the obstruction of the said orifice during emptying.

The protective device 26 has the form of a channel, for example parallelepipedal, engaged in the orifice 13 in the vessel 4, and projecting towards the outside of the vessel 4, in the recess 6. The protective device 26 has a first opening 27 emerging inside the vessel 4, and a second opening 28 emerging in the recess 6, so that the said device 26 cooperates with the opening 13 in the vessel 4 and the retractable hook 9 can be engaged in the said channel.

The end 29 of the said channel emerging in the recess 6 is situated beyond the end 9*a* of the retractable hook 9, when the container 1 is in the filling position and the lid 2 closed, thus preventing access to the hook 9 by means of the fingers of a user.

The protective device 26 has clips 30 (see FIG. 13) enabling it to be locked in the orifice 13 in the front wall 4*c* of the vessel 4.

In addition, the protective device 26 comprises a movable protective element 31 intended to prevent the obstruction of the orifice 13. The protective element 31 consists of bristles 32 juxtaposed on a substantially flat surface, the said protective element 31 being fixed close to a rim 33 of the opening 27 of the channel opening out inside the vessel 4.

When the locking/unlocking device is unlocked, the hook 9 is not engaged in the opening 27 of the protective device 26, and the bristles 32 obstruct the opening 27.

When the locking/unlocking device is locked, the hook 9 is engaged in the opening 27 of the protective device 26, and the bristles 32 are driven back by the hook 9 towards the outside of the vessel 4.

What is claimed is:

1. A locking/unlocking device for a waste collection container, the container having a vessel and a lid associated with the vessel and movable between a closed position and an open position, the device enabling the lid of the container to be locked in a locking position on an end part of the vessel when the container is in a filling position, and to be unlocked when the vessel is in an emptying position, the device comprising a pivoting piece comprising:

a lever fixed so as to be articulated on an internal face of the lid and projecting inside the container when the lid is in the closed position;

an arm extending the articulation of the lever extending underneath the internal face of the lid when the lid is in the closed position;

an intermediate part to which the lever and arm are fixed, through which an axis of rotation of the pivoting piece passes;

wherein the lever has a retractable hook intended to be engaged in an orifice or hollow situated at the end part of the vessel, the arm having an end part, opposite to the intermediate part of the pivoting piece, coming into engagement with a hook forming part of an angled piece, the angled piece comprising a locking leg including the hook and a driving leg and being articulated on an axis of rotation parallel to the axis of rotation of the pivoting piece, the driving leg of the angled piece being locked in the locking position of the lid by a stop, whereby tilting of the container at a certain angle causes, the pivoting of the angled piece and the pivoting of the arm and of the lever towards an unlocked position; and wherein when the container is in the filling position, the centre of gravity of the angled piece holds the driving leg of the angled piece in abutment on the stop and the hook on the angled piece in engagement with the end part of the arm on the pivoting piece, the centre of gravity of an assembly comprising the pivoting piece and the hook being situated to hold the retractable hook on the lever in a position of engagement in the orifice or hollow in the end part of the vessel and the end part of the arm in engagement with the hook on the angled piece; the tilting of the container through the certain angle with respect to the vertical when it is emptied giving rise to a movement of the centers of gravity of the angled piece and of the assembly, causing a pivoting of the angled piece, releasing the hook on the angled piece from the end part of the arm on the pivoting piece, giving rise to the pivoting of the arm and of the lever and leading to the disengagement of the retractable hook from the orifice or hollow in the vessel and therefore to the opening of the lid of the container.

2. The locking/unlocking device according to claim 1, wherein the retractable hook on the lever is articulated on an axis substantially parallel to the axis of rotation of the pivoting piece, allowing, when the lid is closed on the end part of the vessel, a sliding of the retractable hook along the internal wall of the container until the retractable hook is inserted in the orifice or hollow situated at the end part of the vessel.

3. The locking/unlocking device according to claim 1, wherein the pivoting of the arm about the axis of rotation of the pivoting piece is limited in an opposite direction to the internal face of the lid of the container by a stop.

4. The locking/unlocking device according to claim 1, wherein the pivoting of the angled piece is limited in an opposite direction to the internal face of the lid of the container by a stop.

5. The locking/unlocking device according to claim 1, wherein the end part of the arm, opposite to the intermediate part of the pivoting piece, has a weight.

6. The locking/unlocking device according to claim 1, wherein the free end part of the driving leg of the angled piece has a weight.

7. The locking/unlocking device according to claim 1, wherein the angled piece has a shape of a V whose two legs form an angle of around 35 to 55 degrees.

8. The locking/unlocking device according to claim 1, wherein the angled piece has the shape of a V whose two legs form an angle of between 90 and 180 degrees.

9. The locking/unlocking device according to claim 1, further comprising a rocker arm able to move in rotation about a shaft connected to the container lid and substantially parallel to the axis of rotation of the angled piece, the rocker arm being able to move between a locked position in which the rocker arm forms a stop opposing the pivoting of the angled piece towards the internal face of the lid, and an unlocked position in which the rocker arm does not oppose the pivoting of the angled piece, the rotation of the rocker arm between the locked and unlocked positions being obtained when the container is tilted at a certain angle.

10. The locking/unlocking device according to claim 9, wherein the rocker arm has the shape of a circular sector, the axis of rotation of the rocker arm being situated close to an apex of the circular sector, and the free end edge of the rocker arm being, when the rocker arm is in the locked position, in contact with the driving leg of the angled piece.

11. A locking/unlocking device for a waste collection container, the container having a vessel and a lid associated with the vessel and movable between a closed position and an open position, the device enabling the lid of the container to be locked in a locking position on an end part of the vessel when the container is in a filling position, and to be unlocked when the vessel is in an emptying position, the device comprising a pivoting piece comprising:

a lever fixed so as to be articulated on an internal face of the lid and projecting inside the container when the lid is in the closed position;

an arm extending the articulation of the lever extending underneath the internal face of the lid when the lid is in the closed position;

an intermediate part to which the lever and arm are fixed, through which an axis of rotation of the pivoting piece passes;

wherein the lever has a retractable hook intended to be engaged in an orifice or hollow situated at the end part of the vessel, the arm having an end part, opposite to the intermediate part of the pivoting piece, coming into engagement with a hook forming part of an angled piece, the angled piece comprising a locking leg including the hook and a driving leg and being articulated on an axis of rotation parallel to the axis of rotation of the pivoting piece, the driving leg of the angled piece being locked in the locking position of the lid by a stop, whereby tilting of the container at a certain angle causes, the pivoting of the angled piece and the pivoting of the arm and of the lever towards an unlocked position; and wherein the two legs of the angled piece are movable in rotation with respect to each other, about the axis of rotation of the angled piece and the driving leg of the angled piece comprises, towards its end part, a weight so that, when the container is tilted at a certain angle, the locking leg on the angled piece, which is still in engagement with the arm, the driving leg of the angled piece can pivot about its axis and then strike the hook so as to release the hook from the arm.

12. The locking/unlocking device according to claim 11, wherein the driving leg of the angled piece comprises, towards its end part, a projection that, when the container is tilted at a certain angle, strikes the hook to release the hook from the arm.

13. The locking/unlocking device according to claim 1, further comprising a release system fixed to the lid of the container and actuated by a control device, the release system unlocking the lid of the container when the container is in the filling position.

14. The locking/unlocking device according to claim 13, wherein the retractable hook has a ramp, and in that the release system has a finger intended to cooperate with the ramp, the finger being able to be moved, by means of the control device, between:

an inactive position in which the finger is in contact with a first end part of the ramp, and exerts no force on the ramp, the retractable hook being engaged in the orifice or the hollow in the vessel, and an active position in which the finger is in contact with a second end part of the ramp and exerts a force thereon, the retractable hook being disengaged from the orifice or from the hollow in the vessel, whereby a force exerted by the finger on the ramp causing the finger to slide along the ramp, between a first end part and the second end part, and the retractable hook to pivot about its axis of rotation, whilst the elimination of the force leads to the return to the inactive position.

15. The locking/unlocking device according to claim 1, further comprising a housing protecting the device from the contents of the vessel, the housing fixed to the internal face of the lid and having an opening from which the retractable hook of the lever projects.

16. The locking/unlocking device according to claim 15, wherein the housing forms a stop for the angled piece, to limit movement of the angled piece in an opposite direction to the internal face of the lid.

17. A locking/unlocking device according to claim 1, further comprising a protective device for the retractable hook, fixed to the vessel of the container, the device having the form of a channel projecting towards the outside of the vessel and comprising an opening cooperating with the orifice or the hollow in the vessel, one end of the channel being situated beyond the end of the retractable hook, when the container is in the filling position and the lid closed, the protective device also comprising means intended to prevent the obstruction of the orifice during emptying.

* * * * *